US006436626B1

(12) United States Patent
Kawahara et al.

(10) Patent No.: US 6,436,626 B1
(45) Date of Patent: Aug. 20, 2002

(54) HEAT-DEVELOPABLE LIGHT-SENSITIVE ELEMENT

(75) Inventors: Yusuke Kawahara; Tsukasa Ito; Tsuyoshi Mitsuhashi, all of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/625,460

(22) Filed: Jul. 25, 2000

(30) Foreign Application Priority Data

Aug. 6, 1999 (JP) ..... 11-223620

(51) Int. Cl.[7] ..... G03C 1/498
(52) U.S. Cl. ..... 430/619
(58) Field of Search ..... 430/619, 617, 430/203, 620

(56) References Cited

U.S. PATENT DOCUMENTS 5,998,127 A * 12/1999 Toya et al. ..... 430/619

FOREIGN PATENT DOCUMENTS

JP 282601 10/1998

OTHER PUBLICATIONS

Donald H. Klosterboer, Thermally Processed Silver Systems, Chapter 9, pp. 279 to 291.

* cited by examiner

*Primary Examiner*—Thorl Chea
(74) *Attorney, Agent, or Firm*—Biermsn, Muserlian and Lucas

(57) ABSTRACT

A heat-developable light-sensitive element is disclosed. The element comprises a non-light-sensitive organic silver salt and a light-sensitive silver halide and an average radius r of the sphere of influence is from 0.35 $\mu$m to 10 $\mu$m when the element is exposed to light of from 35 $\mu J/cm^2$ to 50 $\mu J/cm^2$ and developed by a developing drum at a temperature of 123°±3° C. for a time of 16±3 seconds.

4 Claims, 1 Drawing Sheet

HEAT-DEVELOPABLE LIGHT-SENSITIVE ELEMENT

FIELD OF THE INVENTION

The invention relates to a heat-developable light-sensitive element, particularly relates to a heat-developable light-sensitive element which gives a lowered fog and a high maximum density and is inhibited in the variation of density depending on the fluctuation of the developing condition.

BACKGROUND OF THE INVENTION

Recently, it is strongly demanded to reduce the amount of the effluent of a processing liquid for protecting the environment and saving the space. Therefore, technology is required which relates to the heat-developable light-sensitive element suitable for the use of the medical diagnosis or the technological photography which is capable of being efficiently exposed by a laser imager or a laser image setter to form an image with a high resolution and a high sharpness. A simple heat development system using no liquid processing chemical and accompanying no environmental pollution can be provided by such the heat-developable light-sensitive element.

As the heat-developable light-sensitive element, a black-and-white heat-developable light-sensitive element so called "dry silver" has been known, which is described in various publications such as U.S. Pat. No. 5,343,043 and Research Disclosure (DS) No. 17,029.

Many photographic properties are required to the heat-developable light-sensitive element such as a lowered fog and a high maximum density. Many techniques are disclosed for improving the fog and the maximum density. However, a sufficient technical resolution has not be obtained by the known technology.

Japanese Patent Publication Open to Public Inspection (JP O.P.I.) No. 10-282601 discloses a method in which the radius of sphere of influence when the element is exposed to light of 30 $\mu J/cm^2$ and developed at 120° C. for 20 seconds is limited for the purpose of giving an image with a little tone variation. However, the publication does not describe with respect to the fogging property and the maximum density, even though the effect of the technique for giving an image without tone variation is recognized.

SUMMARY OF THE INVENTION

The object of the invention is to provide a heat-developable light-sensitive element having a low fogging and a high maximum density and an inhibited density variation depending on the fluctuation of the developing condition.

The invention and embodiments thereof are described.

A heat-developable light-sensitive element comprising a non-light-sensitive organic silver salt and a light-sensitive silver halide wherein an average radius r of the sphere of influence is from 0.35 $\mu$m to 10 $\mu$m when the element is exposed to light of from 35 $\mu J/cm^2$ to 50 $\mu J/cm^2$ and developed by a developing drum at a temperature of 123°±3° C. for a time of 16±3 seconds.

It is preferable that the average radius of the sphere of influence r is from 0.50 $\mu$m to 1.00 $\mu$m in the heat-developable light-sensitive element described in the above.

The heat-developable light-sensitive element comprising a non-light-sensitive organic silver salt and light-sensitive silver halide and the ratio $r_2/r_1$ is from 1.5 to 3.0, wherein $r_1$ is the average radius of sphere of influence when the element is exposed to light of from 35 $\mu J/cm^2$ to 50 $\mu J/cm^2$ and developed by a developing drum at a temperature of 123°±3° C. for a time of 8±3 seconds, and $r_2$ is the average radius of sphere of influence when the element is exposed to light of from 35 $\mu J/cm^2$ to 50 $\mu J/cm^2$ and developed by a developing drum at a temperature of 123°±3° C. for a time of 16±3 seconds.

The ratio of the average radius of sphere of influence $r_2$ to $r_1$, $r_2/r_1$, is preferably within the range of from 2.0 to 2.8.

A preferable example of the developing drum is KONICA LASER IMAGER DRYPRO MODEL 722.

DETAILED DESCRIPTION OF THE INVENTION

In the heat-developable light-sensitive element of the invention, it is preferable that the average radius of sphere of influence r is within the range of from 0.35 $\mu$m to 1.10 $\mu$m, more preferably from 0.50 $\mu$m to 1.00 $\mu$m, when the element is exposed to light of from 35 $\mu J/cm^2$ to 50 $\mu J/cm^2$ and developed by the later-mentioned developing drum at a temperature of 123°±3° C. for a time of 16±3 seconds.

In the heat-developable light-sensitive element of the invention, it is preferable that the ratio of $r_2/r_1$ is preferably within the range of from 1.5 to 3.0, more preferably from 2.0 to 2.8, wherein $r_1$ is the average radius of sphere of influence when the element is exposed to light of from 35 $\mu J/cm^2$ to 50 $\mu J/cm^2$ and developed by the later-mentioned developing drum at a temperature of 123°±3° C. for a time of 8±3 seconds and $r_2$ is the average radius of sphere of influence when the element is exposed to light of from 35 $\mu J/cm^2$ to 50 $\mu J/cm^2$ and developed by the later-mentioned developing drum at a temperature of 123°±3° C. for a time of 16±3 seconds.

Figure 1:
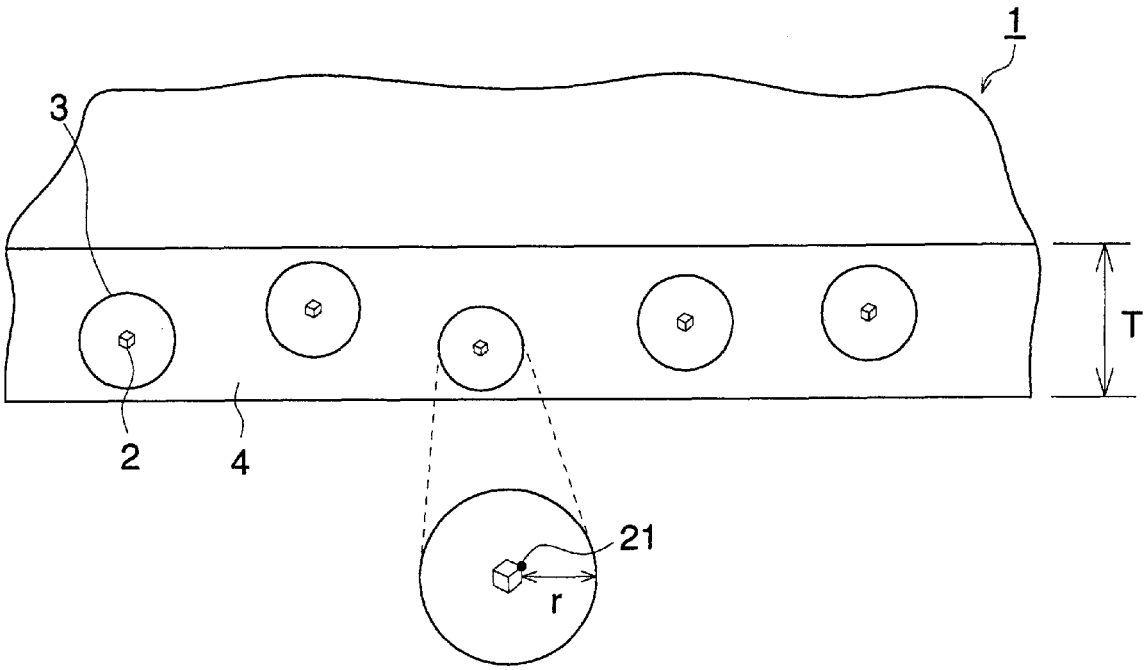
FIG. 1 is a drawing describing the sphere of influence.

The sphere of influence is an area formed around the developed silver derived from the light-sensitive silver halide, in which the non-light-sensitive organic silver salt is disappeared. The schema of such the situation is shown in FIG. 1. As is shown in FIG. 1, in the heat-developable light-sensitive layer or emulsion layer 1 having a prescribed thickness T, usually from 0.5 to 50 $\mu$m, and containing a light-sensitive silver halide and a non-light-sensitive organic silver salt, a latent image 21 is formed in the silver halide grain 2 by decomposition of the silver halide caused by the exposure. Then the heat development is applied, a reaction for reducing the organic silver salt to silver is progressed by the catalysis of the silver. As a result the reaction, a spherical part in which the organic silver salt is disappeared is formed around the developed image which is formed by the effect of the physical development nucleus of the latent image silver formed by light. The portion in which the organic silver salt is disappeared is the sphere of influence 3. In the heat-developable light-sensitive layer 1, the part 4 other than the sphere of influence is remained as the undeveloped status. The average radius of the sphere of influence is the average of diameter corresponding to a diameter of circle or r in FIG. 1 having the area the same as the projection area of the sphere of influence.

The sphere of influences may be overlapped with each other, and the overlapping is preferable. When the sphere of influences are overlapped, the variation of the catalysis effect of the light-sensitive silver halide can be easily inhibited.

The sphere of influence can be detected by projecting the cross-section image by transmission electron microscope (TEM), and the average radius of the sphere of influence 3 can be determined according to the TEM cross-section image.

The exposure amount is an amount of light at the surface of the light-sensitive element. There is no limitation on the moisture condition of the light-sensitive element to be determined.

The sphere of influence is described in D. H. Klosterboer "Imaging Processes and Materials", edition 8, "Van Nostrand Reinhold : NY"1984, edited by Sturge et al., Chapter 9, and "Journal of Imaging Science and Technology", vol. 40, No. 6, November/December 1996, p. 568. In these publications, values of the sphere of influence are concretely described. However, the exposure condition is not cleared and the relation between the value of the sphere of influence and the specific photographic properties of the heat-developable light-sensitive element is not described.

In the invention, it has been found that the lowered fogging and the high maximum density of the heat-developable light-sensitive element can be obtained and the variation of the image density depending on the fluctuation of the developing condition can be inhibited when the average radius of the sphere of influence formed by the specified exposure and the specified heat development conditions, and the ratio thereof satisfy the foregoing conditions. The fog is raised when the average radius of the sphere of influence exceeds 1.10 $\mu$m, and the maximum density is reduced when the average radius of the sphere of influence is lower than 0.35 $\mu$m. Moreover, the all properties of the element cannot improved when the ratio of the sphere of influences does not satisfy the foregoing limitation.

The limitation of the sphere of influence of the heat-developable light-sensitive element of the invention can be attained by 1) making the average radius and the grain diameter distribution of the non-light-sensitive organic silver salt grains to the those within the later-mentioned preferable range,
2) controlling the amount of the light-sensitive silver halide versus to that of the non-light-sensitive organic silver salt so that the ratio is made within the later-mentioned preferable range,
3) controlling the amount of the reduction agent so that the amount is within the later-mentioned preferable range,
4) controlling the amount of the fog inhibitor so that the amount is within the later-mentioned preferable range, and
5) controlling the amount of the toning agent so that the amount is within the later-mentioned preferable range.

A method in which the light-sensitive silver halide and the non-light-sensitive organic silver salt are separately prepared and mixed with together is preferable compared to a method in which a part of the non-light-sensitive organic salt is halogenized to form the light-sensitive silver halide for enhancing the effects of the invention since the spatial uniformity of dispersion of the both components is raised in the former method. It is also a preferable embodiment that a chalcogen sensitization is applied to the light-sensitive silver halide for considerably enhancing the effects of the invention.

The organic silver salts are reducible silver sources and preferred are organic acids employed in the present invention, and silver salts of hetero-organic acids having a reducible silver ion source, specifically, long chain (having from 10 to 30 carbon atoms, but preferably from 15 to 25 carbon atoms) aliphatic carboxylic acids and nitrogen-containing heterocyclic rings. Organic or inorganic silver salt complexes are also useful in which the ligand has a total stability constant for silver ion of 4.0 to 10.0.

Examples of preferred silver salts are described in Research Disclosure, Items 17029 and 29963, and include the following; organic acid salts (for example, salts of gallic acid, oxalic acid, behenic acid, arachidic acid, stearic acid, palmitic acid, lauric acid, etc.); carboxyalkylthiourea salts (for example, 1-(3-carboxypropyl)thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.)), hydroxy-substituted acids (for example, salicylic acid, benzoic acid, 3,5-dihydroxybenzoic acid, 5,5-thiodisalicylic acid, silver salts or complexes of thioenes (for example, 3-(2-carboxyethyl)-4-hydroxymethyl-4-(thiazoline-2-thioene and 3-carboxymethyl-4-thiazoline-2-thioene)), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides.

In the present invention, of these, the preferred organic silver salts are silver behenate, silver arachidate, and/or silver stearate.

Although there is no limitation on the shape of the non-light-sensitive organic silver salt particle to be used in the invention, a circular or oval plane crystal, an acicular crystal having a major and minor axes, and a mixture of them are preferable. Among them it is preferable that the circular or oval plane crystals account for majority in the mixture.

It is preferable that the non-light-sensitive organic silver salt is dispersed into a form of fine particle. The average radius of the particle is preferably from 0.1 $\mu$m to 1.2 $\mu$m, more preferably from 0.1 $\mu$m to 0.8 $\mu$m. It is preferable that the non-light-sensitive organic silver salt is uniformly dispersed and the diameter distribution of the dispersion of the particle is narrow. In concrete, it is preferable that the particles each having a diameter of not more than 0.9 $\mu$m account for not less than 60%, more preferably not less than 57%, further preferably not less than 90%, by weight of the organic silver salt. A granularity and distribution measuring apparatus is preferably used for determining the average particle diameter and the distribution of the particle diameter. For example, a method is usable in which the organic silver salt dispersed in a liquid is irradiated by laser light, and the particle diameter and the distribution thereof are determined according to thus obtained self-correlation function of the fluctuation of scattered light depending to the variation of time.

The dispersion of non-light-sensitive organic silver salt can be obtained by mixing silver nitrate and an organic alkali metal salt, and a mixing procedure is preferred in which the silver nitrate is added after the addition of the light-sensitive silver halide at the formation of the organic silver salt. For example, the dispersion of non-light-sensitive organic silver salt to be used in the invention can be prepared by the following procedure; an alkali hydroxide such as sodium hydroxide or potassium hydroxide is added to an organic acid to form a an organic acid alkali metal soap such as sodium behenate or sodium arachidate, then light-sensitive silver halide was added, after that, silver nitrate is added and mixed. It is also one of preferable embodiments for preparing the non-light-sensitive organic silver salt to be used in the invention that an alkali metal salt of an organic acid, silver nitrate and silver halide are simultaneously added and mixed by a procedure so called a controlled triple-jet method.

Silver halide grains of photosensitive silver halide in the present invention work as a light sensor. In order to minimize translucence after image formation and to obtain excellent image quality, the less the average grain size, the more preferred, and the average grain size is preferably less than 0.1 μm; is more preferably between 0.01 and 0.1 μm, and is most preferably between 0.02 and 0.08 μm.

The grain size as described herein denotes an edge length of silver halide grains, when they are so-called regular crystals of cube or octahedron. Furthermore, when grains are not regular crystals, for example, spherical, cylindrical, and tabular grains, the grain size refers to the diameter of a sphere having the same volume as the silver grain.

Furthermore, silver halide grains are preferably monodisperse grains. The monodisperse grains as described herein refer to grains having a monodispersibility obtained by the formula described below of less than 40 percent; more preferably less than 30 percent, and most preferably between 0.1 and 20 percent.

Monodispersibility=(standard deviation of grain diameter)/(average of grain diameter)×100

The silver halide grain shape is preferred, in which a high ratio occupying a Miller index (100) plane is preferred. This ratio is preferably at least 50 percent; is more preferably at least 70 percent, and is most preferably at least 80 percent. The ratio occupying the Miller index (100) plane can be obtained based on T. Tani, J. Imaging Sci., 29, 165 (1985) in which adsorption dependency of a (111) plane and a (100) plane is utilized.

Furthermore, another preferred silver halide shape is a tabular grain. The tabular grain as described herein is a grain having an aspect ratio represented by r/h of at least 3, wherein r represents a grain diameter in μm obtained as the square root of the projection area, and h represents thickness in μm in the vertical direction.

Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved.

The composition of silver halide may be any of silver chloride, silver chlorobromide, silver chloroiodobromide, silver bromide, silver iodobromide, or silver iodide.

The photographic emulsion employed in the present invention can be prepared employing methods described in P. Glafkides, "Chimie et Physique Photographique" (published by Paul Montel Co., 1967), G. F. Duffin, "Photographic Emulsion Chemistry" (published by The Focal Press, 1966), V. L. Zelikman et al., "Making and Coating Photographic Emulsion" (published by The Focal Press, 1964), etc.

Silver halide is preferably comprised of ions of metals or complexes thereof, in transition metal belonging to Groups 6 to 11 of the Periodic Table. As the above-mentioned metals, preferred are W, Fe, Co, Ni, Cu, Ru, Rh, Pd, Re, Os, Ir, Pt and Au.

These metals may be incorporated into silver halide in the form of complexes. In the present invention, regarding the transition metal complexes, six-coordinate complexes represented by the formula described below are preferred.

$$(ML_6)^m$$

wherein M represents a transition metal selected from elements in Groups VIB, VIIB, VIII, and IB of the Periodic Table; L represents a coordinating ligand; and m represents 0, −1, −2, or −3.

Specific examples represented by L include halogens such as fluorine, chlorine, bromine, and iodine, cyan, cyanato, thiocyanato, selenocyanato, tellurocyanato, each ligand of azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred specific example of M is rhodium (Rh), ruthenium (Ru), rhenium (Re), iridium (Ir) or osmium (Os).

Specific examples of transition metal ligand complexes are described below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[IrCl_6]^{4-}$
7: $[Ru(NO)Cl_5]^{2-}$
8: $[RuBr_4(H_2O)]^{2-}$
9: $[Ru(NO)\ (H_2O)Cl_4]^{-}$
10: $[RhCl_5(H_2O)]^{2-}$
11: $[Re(NO)Cl_5]^{2-}$
12: $[Re(NO)CN_5]^{2-}$
13: $[Re(NO)ClCN_4]^{2-}$
14: $[Rh(NO)_2Cl_4]^{-}$
15: $[Rh(NO)\ (H_2O)Cl_4]^{-}$
16: $[Ru(NO)CN_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)\ Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[Ir(Ns)Cl_5]^{2-}$
28: $[IrCl_6]^{2-}$

One type of these metal ions or complex ions may be employed and the same type of metals or the different type of metals may be employed in combinations of two or more types.

Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As described in Japanese Patent Publication Open to Public Inspection No. 63-29603, 2-306236, 3-167545, 4-76534, 6-110146, 5-273683, etc., incorporation can be carried out so as to result preferably in distribution formation in the interior of a grain. These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution.

When the addition is carried out onto grain surfaces, an aqueous solution comprising the necessary amount of a metal compound can be placed in a reaction vessel immediately after grain formation, or during physical ripening or at the completion thereof or during chemical ripening.

The light sensitive silver halide emulsion is desalted by washing such as noodle method, flocculation method etc. Desalt processing is not required in the invention.

The light sensitive silver halide grains are preferably chemically ripened. The preferable chemical ripening method includes sulfur sensitization, selenium sensitization and tellurium sensitization. Further noble metal sensitization employing gold, platinum, palladium or iridium compound, or reduction sensitization may be applied. Examples of compounds employed in sulfur sensitization, selenium sensitization and tellurium sensitization includes those described in Japanese Patent Publication Open to Public Inspection No. 7-128768. Examples of tellurium compound includes diacyltellurides, bis(oxycarbonyl)tellurides, bis (carbamoyl)tellurides, diacyltellurdes, bis(oxycarbonyl) ditellurides, bis(carbamoyl)ditellurides, compounds containing P═Te bonding, salts of tellurocarbonic acid, Te-organyltellurocarbonic acid esters, telluride, tellurols, telluroacetals, tellurosulfonates, compounds containing P—Te bonding, heterocyclic compounds containing Te, tellurocarbonyl compounds, inorganic tellurium compounds and colloidal tellurium.

Examples of compounds employed in noble metal sensitization includes, auric acid, potassium chloroaurate, potassium aurithiocyanate, gold sulfide, gold selenide, and compounds described in U.S. Pat. No. 2,448,061, British Patent No. 618,061.

Concrete examples employed in reduction sensitization includes, in addition to ascorbic acid and thioureadioxide, stannous chloride, aminoisomethanesulfinic acid, hydrazine derivatives, borane compounds, silane compounds and polyamine compounds. Reduction sensitization can be conducted by ripening the emulsion being kept at pH of not less than 7 or at pAg of not more than 8.3. Reduction sensitization can also be conducted by introducing single addition part during the forming silver halide grains.

In the invention, the amount of the light-sensitive silver halide to the non-light-sensitive organic silver salt is preferably from 0.01 moles to 0.30 moles, more preferably from 0.03 moles to 0.25 moles, particularly preferable from 0.05 moles to 0.18 moles, in terms of silver, per mole of the non-light-sensitive organic silver salt, in terms of silver.

As above-mentioned, the light-sensitive silver halide to be contained in the heat-developable light-sensitive element according to the invention is preferably prepared separately from the non-light-sensitive organic silver salt and mixture of them. The method for mixing them includes a method by which the light-sensitive silver halide and the non-light-sensitive organic silver salt each separately prepared are mixed by a high-speed stirrer, a ball mill, a colloid mil, a vibration mill or a homogenizer, and a method by which the previously prepared light-sensitive silver halide is mixed at a time in the course of preparation of the organic silver salt.

Reducing agents are used in the heat-developable light-sensitive elements, including phenols, polyphenols having two or more phenols, naphthols, bisnaphthols, polyhydoxybenzenes having two or more hydroxy groups, polyhydoxynaphthalenes having two or more hydroxy groups, ascorbic acids, 3-pyrazolidones, pyrazoline-5-ones, pyrazolines, phenylenediamines, hydroxyamines, hydroquinone monoethers, hydrooxamic acids, hydrazides, amidooximes, and N-hydroxyureas. Further, exemplary examples thereof are described in U.S. Pat. Nos. 3,615,533, 3,679,426, 3,672,904, 3,51,252, 3,782,949, 3,801,321, 3,794,488, 3,893,863, 3,887,376, 3,770,448, 3,819,382, 3,773,512, 3,839,048, 3,887,378, 4,009,039, and 4,021,240; British Patent 1,486,148; Belgian Patent 786,086; Japanese Patent Publication Open to Public Inspection Nos. 50-36143, 50-36110, 50-116023, 50-99719, 50-140113, 51-51933, 51-23721, 52-84727; and Japanese Patent Publication No. 51-35851. Reducing agents may be selected from these optionally. It is easy to evaluate the photographic property of the reducing agent by preparing thermal developable photosensitive material actually.

Of these reducing agents, in cases where fatty acid silver salts are used as an organic silver salt, preferred reducing agents are polyphenols in which two or more phenols are linked through an alkylene group or a sulfur atom, specifically, polyphenols in which two or more phenols are linked through an alkylene group or a sulfur atom and the phenol(s) are substituted at least a position adjacent to a hydroxy group by an alkyl group (e.g., methyl, ethyl, propyl, t-butyl, cyclohexyl) or an acyl group (e.g., acetyl, propionyl). Examples thereof include polyphenols compounds such as 1,1-bis(2-hydroxy-3,5-dimethylphenyl)-3,5,5-trimethylhexane, 1,1-bis(2-hydroxy-3-t-butyl-5-methyphenyl)methane, 1,1-bis(2-hydroxy-3,5-di-t-butylphenyl)methane, 2-hydroxy-3-t-butyl-5-methylphenyl)-(2-hydroxy-5-methylphenyl)methane, 6,6'-benzylidene-bis(2,4-di-t-butylphenol), 6,6'-benzylidene-bis (2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis( 4-hydroxy-3,5-dimethylphenyl)propane, 2,2-bis(4-hydroxy-3,5-di-t-butylphenyl)propane, as described in U.S. Pat. No. 3,589,903 and 4,021,249, British Patent 1,486,148, JP-A 51-51933, 50-36110 and 52-84727 and JP-B 51-35727; bisnaphthols described in U.S. Pat. No. 3,672,904, such as 2,2'dihydoxy-1,1'-binaphthyl, 6,6'-dibromo-2,2'-dihydroxy-1,1'-binaphthyl, 6,6'-dinitro-2,2'-dihydroxy-1,1'-binaphtyl, bis(2-hydroxy-1-naphthyl)methane, 4,4'-dimethoxy-,1,1'-dihydroxy-2,2'-binaphthyl; sulfonamidophenols or sulfonamidonaphthols described in U.S. Pat. No. 3,801,321, such as 4-benzenesulfonamidophenol, 2-benzenesulfonamidophenol, 2,6-dichloro-4-benzenesulfonamidophenol and 4-benzenesulfonamidonaphthol.

The amount of the reducing agent to be used in the heat-developable light-sensitive element, depending on the kind of an organic silver salt or reducing agent is preferably 0.01 to 10 mol, and more preferably 0.01 to 3 mol per mol of organic silver salt.

Incorporation of antifoggants into the heat-developable light-sensitive element of the present invention is preferable. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by —C(X1)(X2)(X3) (wherein X1 and X2 each represents halogen, and X3 represents hydrogen or halogen), as disclosed in U.S. Pat. Nos. 3,874,946 and 4,756,999.

As examples of suitable antifoggants, employed preferably are compounds etc. described in paragraph numbers [0062] and [0063] of Japanese Patent Publication Open to Public Inspection No. 9-90550.

Furthermore, more suitable antifoggants are disclosed in U.S. Pat. No. 5,028,523, and EP Nos. 600,587, 605,981, and 631,176.

Content of the antifoggant employed in the invention is preferably $1.0\times10^{-4}$ to 10 mol per mol of silver and more preferably $1.0\times10^{-3}$ to 1.5 mol per mol of silver.

Image color control agents are preferably incorporated into the heat-developable light-sensitive element to which the present invention is applied. Examples of suitable image color control agents are disclosed in Research Disclosure Item 17029, and include the following;

imides (for example, phthalimide), cyclic imides, pyrazoline-5-ones, and quinazolinon (for example, succinimide, 3-phenyl-2-pyrazoline-5-one, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)-bis-(isothiuroniumtrifluoroacetate), and 2-(tribromomethylsulfonyl)benzothiazole; merocyanine dyes (for example, 3-ethyl-5-((3-ethyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, combination of 6-chlorophthalazinone and benzenesulfinic acid sodium or combination of 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphtoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

The toning agent such as phthalazinone and phthalazine is employed preferably in an amount of 1.0×10 to 10 mols per 1 mol of silver, particularly 1.0×10 to 5 mols per 1 mol of silver.

In the heat-developable light-sensitive element to which the present invention is applied, employed can be sensitizing dyes described, for example, in Japanese Patent Publication Open to Public Inspection Nos. 63-159841, 60-140335, 63-231437, 63-259651, 63-304242, and 63-15245; U.S. Pat. Nos. 4,639,414, 4,740,455, 4,741,966, 4,751,175, and 4,835,096.

Useful sensitizing dyes employed in the present invention are described, for example, in publications described in or cited in Research Disclosure Items 17643, Section IV-A (page 23, November 1978), 1831, Section X (page 437, August 1978). Particularly, selected can advantageously be sensitizing dyes having the spectral sensitivity suitable for spectral characteristics of light sources of various types of scanners. For example, compounds are preferably employed which are described in Japanese Patent Publication Open to Public Inspection Nos. 9-34078, 9-54409, and 9-80679, and Japanese Patent Application No. 11-58686.

A mercapto compound, a disulfide compound or a thione compound may be applied to the present invention for the purpose of controlling development as inhibited or accelerated, enhancing optical sensitization efficiency or improving storage stability before or after development of the photosensitive material.

In cases where the mercapto compound is used in the present invention, any compound having a mercapto group can be used, but preferred compounds are represented by the following formulas, Ar—SM and Ar—S—S—Ar.

In the above-mentioned formulas, M represents a hydrogen atom or an alkaline metal atom, Ar represents an aromatic ring compound or a condensed aromatic ring compound having at least a nitrogen, sulfur, oxygen, selenium or tellurium. Preferable heteroaromatic ring compounds include benzimidazole, naphthoimidazole, benzothiazole, naphthothiazole, benzoxazole, naphthooxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazoline. These heteroaromatic ring compounds may contain a substituent selected from a halogen atom (e.g., Br and Cl), a hydroxy group, an amino group, a carboxy group, an alkyl group (e.g., alkyl group having at least a carbon atom, preferably 1 to 4 carbon atoms) and an alkoxy group (e.g., alkoxy group having at least a carbon atom, preferably 1 to 4 carbon atoms). Examples of mercapto-substituted heteroaromatic ring compounds include 2-mercaptobenzimidazole, 2-mercaptobenzoxazole, 2-mercaptobenzothiazole, 2-mercapto-5-methylbenzothiazole, 3-mercapto-1,2,4-triazole, 2-mercaptoquinoline, 8-mercaptopurine, 2,3,5,6-tetrachloro-4-pyridinethiol, 4-hydroxy-2-mercaptopyrimidine and 2-mercapto-4-phenyloxazole.

In the present invention, a matting agent is preferably incorporated into the photosensitive layer side. In order to minimize the image abrasion after thermal development, the matting agent is provided on the surface of a photosensitive material and the matting agent is preferably incorporated in an amount of 0.5 to 30 percent in weight ratio with respect to the total binder in the emulsion layer side.

In case that the matting agent is incorporated in a non-photosensitive layer provided on opposite side to the emulsion layer side with reference to support, it is preferable to incorporate it at least one of layer of the non-photosensitive layer. In order to improve lubrication or minimize the finger print adhering, the matting agent is provided on the surface of a photosensitive material and the matting agent is preferably incorporated in an amount of 0.5 to 40 percent in weight ratio with respect to the total binder in the non-photosensitive layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc.

Regarding organic substances, as organic matting agents those can be employed which is starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed.

The size of a matting agent is expressed in the diameter of a sphere which has the same volume as the matting agent. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below.

(Standard deviation of grain diameter)/(average grain diameter)× 100

The matting agent according to the present invention can be incorporated into arbitrary construction layers. In order to accomplish the object of the present invention, the matting agent is preferably incorporated into construction layers other than the photosensitive layer, and is more preferably incorporated into the farthest layer from the support surface.

Methods of adding the matting agent include those in which a matting agent is previously dispersed into a coating composition and is then coated, and prior to the completion of drying, a matting agent is sprayed. When a plurality of matting agents are added, both methods may be employed in combination.

In the present invention, in order to improve electrification property of the heat-developable light-sensitive element, electrically conductive compound such as a metal oxide and/or an electrically conductive polymer can be incorporated into a photographic component layer. These compounds can be incorporated into any of the photographic component layer. These compounds may preferably be incorporated into a sublayer, a backing layer, and a layer between a photosensitive layer and a sublayer.

The electrically conductive compounds preferably used in the present invention are described in U.S. Pat. No. 5,244,773, on columns 14 through 20.

Various additives may be incorporated into any of the photosensitive layers, non-photosensitive layers, and other composition layers. Incorporated into the heat-developable light-sensitive element of the present invention may be incorporated additives other than those described above, such as surface active agents, antioxidants, stabilizers, plasticizers, UV absorbers, coating aids, etc. Preferably employed as these additives, as well as those described above, may be compounds described in Research Disclosure Item 17029.

Binders suitable for the heat-developable light-sensitive element to which the present invention is applied are transparent or translucent, and generally colorless.

Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly(methylmethacrylic acid), poly(vinyl chloride), poly (methacrylic acid), copoly(styrene-maleic acid anhydride), copoly(styrene-acrylonitrile), copoly(styrene-butadiene), poly(vinyl acetal) series [for example, poly(vinyl formal) and poly(vinyl butyral)], poly(ester) series, poly(urethane) series, phenoxy resins, poly(vinylidene chloride), poly (epoxide) series, poly(carbonate) series, poly(vinyl acetate) series, cellulose esters, poly(amide) series. These may be hydrophilic or hydrophobic. However, in the present invention, the binder is preferably transparent to reduce fogging after thermal development. As the preferable binder, are cited poly(vinyl butyral), cellulose acetate, cellulose acetatebutylate, polyester, polycarbonate, polyacrylic acid, polyurethane, etc. Of these, poly(vinyl butyral), cellulose acetate, cellulose acetatebutylate and polyester are preferably employed. They may be hydrophilic or hydrophobic.

Furthermore, in order to protect the surface of photosensitive materials as well as to minimize abrasion thereof, non-photosensitive layers may be provided on the outside of photosensitive layers. Binders employed in such non-photosensitive layers may be the same type as those employed in the photosensitive layers or may be different.

In the present invention, in order to enhance the rate of thermal development and appropriate density, the amount of binders in a photosensitive layer is preferably 1.5 to 10 g/m$^2$, and is more preferably 1.7 to 8 g/m$^2$.

Supports employed in the present invention are preferably, in order to obtain predetermined optical density after development processing and to minimize the deformation of images after development processing, plastic films (for example, polyethylene terephthalate, polycarbonate, polyimide, nylon, cellulose triacetate, polyethylene naphthalate).

Of these, as preferred supports, listed are polyethylene terephthalate (hereinafter referred to as PET) and other plastics comprising styrene series polymers having a syndiotactic structure (hereinafter referred to as SPS). The thickness of the support is about 50 to about 300 $\mu$m, and is preferably 70 to 180 $\mu$m.

Furthermore, thermally processed plastic supports may be employed. As acceptable plastics, those described above are listed. The thermal treatment of the support, as described herein, is that after film casting and prior to the photosensitive layer coating, these supports are heated to a temperature at least 30° C. higher than the glass transition point by not less than 30° C. and more preferably by at least 40° C. However the supports may nit be heated at temperature over melting point of the supports.

Plastics employed in the present invention are-described below.

PET is a plastic in which all the polyester components are composed of polyethylene terephthalate. However, other than polyethylene terephthalate, employed also may be polyesters in which modified polyester components such as acid components, terephthalic acid, naphthalene-2,6-dicaroxylic acid, isophthalic acid, butylenecarboxylic acid, 5-sodiumsulfoisophthalic acid, adipic acid, etc., and as glycol components, ethylene glycol, propylene glycol, butanediol, cyclohexane dimethanol, etc. may be contained in an amount of no more than 10 mole percent, with respect to the total polyester content.

SPS is different from normal polystyrene (atactic polystyrene) and a polystyrene having stereoregularity. The stereoregular structure portion of SPS is termed a racemo chain and the more regular parts increase as 2 chains, 3 chains, 5 chains or more chains, the higher being, the more preferred. In the present invention, the racemo chains are preferably not less than 85 percent for two chains, not less than 75 percent for three chains, not less than 50 percent for five chains, and 30 percent for not less than 5 chains. SPS can be polymerized in accordance with a method described in Japanese Patent Publication Open to Public Inspection No. 3-131843.

As the base casting method of the support and subbing production method which are associated with the present invention, any of those known in the art can be employed. However, those methods described in paragraphs [0030] through [0070] of Japanese Patent Publication Open to Public Inspection No. 9-50094 are preferably employed.

The heat-developable light-sensitive element of the present invention comprises a support having thereon at least one photosensitive layer. Said photosensitive layer may be formed only on a support, but at least one non-photosensitive layer is preferably formed on the photosensitive layer. In order to control the light quantity passing through the photosensitive layer or to control the wavelength range, formed may be a filter dye layer on the photosensitive layer side and/or an antihalation layer, a so-called backing layer on the reverse side, and dyes or pigments may be incorporated into the photosensitive layer. Any dyes which show specified absorption in the desired wavelength region may be employed but compounds are preferably employed which are described in, for example, Japanese Patent Publication Open to Public Inspection Nos. 59-6481 and 59-182436; U.S. Pat. Nos. 4,271,263 and 4,594,312; European Patent Publication Open to Public Inspection Nos. 533,008 and 652,473; Japanese Patent Publication Open to Public Inspection Nos. 2-215140, 4-348339, 7-1914323, and 7-301890; etc.

Furthermore, said binders, as well as matting agents, are preferably incorporated into these non-photosensitive layers. Still further, lubricant such as polysiloxane compounds, waxes, and liquid paraffin may also be incorporated.

The photosensitive layer may be composed of plural layers, such as high sensitive layer/low sensitive layer or low sensitive layer/high sensitive layer to control gradation.

The heat-developable light-sensitive element of the present invention is stable at normal temperature, however, after exposure, when heated at a relatively high temperature (for example, 80 to 140° C.), it undergoes development. Heating results in an oxidation-reduction reaction between the organic silver salt, which works as an oxidizing agent, and the reducing agent to form silver. Said oxidation-reduction reaction is accelerated by the catalytic action of the latent image formed on exposed silver halides. An image is formed in such a manner that silver formed through the reaction of the organic silver salt provides a black image which is in contrast to unexposed areas. Said reaction proceeds without the supply of processing solutions, such as water. The unreacted silver halide and organic silver at unexposed portion remain in the photosensitive material without being removed.

As heat-developable light-sensitive element to which the processing method of the present invention is applied, those can be employed which are disclosed, as described above, in, for example, U.S. Pat. Nos. 3,152,904 and 3,457,075, and D. Morgan, "Dry Silver Photographic Material" and D. Morgan and B. Shely, "Thermally Processed Silver Systems" (Imaging Processes and Materials) Neblette, 8th Edition, edited by Sturge, V. Walworth, and A. Shepp, page 2, 1969), etc.

Although a hot air heating method and a heating drum method are usually used for a heat developing apparatus of the heat-developable light-sensitive element, the light-sensitive material according to the invention is preferably developed by the heating drum heat developing apparatus. The heating drum is preferably a metal made heating drum. A metal heating drum having a heat conductivity of from 10 to 210 W/mK, a specific heat of from 0.2 to 1.2 kJ/kgK, a density of from 2 to 10 g/cm$^3$ and a thickness of from 0.1 to 50 mm is particularly preferred.

The heat-developable light-sensitive element of the invention is preferably developed particularly by heating by a heat developing apparatus having a heating drum which is a metal made heating drum coated with a silicone rubber layer on the surface thereof. It is most preferable that the silicone rubber layer to be coated on the surface of the drum has a heat conductivity of from 0.1 to 1.0 W/mK, a specific heat of from 1.0 to 2.0 kJ/kgK, a density of from 0.8 to 2.0 g/cm$^3$ and a thickness of from 0.05 to 5 mm.

The heat-developable light-sensitive-element is developed by a developing drum in determining the sphere of influence. For the purpose the heat developing apparatus having heating drum mentioned above is employed. The practical example of the heat developing apparatus includes KONICA LASER IMAGER DRYPRO MODEL 722 manufactured by Konica Corporation.

It is preferable that the heat developable light-sensitive element according to the invention has a transparent optical density at 400 nm after the heat development of not more than 0.2, more preferably from 0.02 to 0.2 including the density of the support.

EXAMPLES

The invention is described according to examples below.

Example 1

<Preparation of Silver Halide Emulsion A>

In 900 ml of water, 7.5 g of gelatin having an average molecular weight of 120,000 and 10 mg of potassium bromide were dissolved. The pH value of the solution was adjusted to 3.0 at 45° C. by a nitric acid solution of 1 mole/l. To the solution, 370 ml of an aqueous solution containing 74 g of silver nitrate and 370 ml of an aqueous solution containing 50.8 g of potassium bromide and 1.45 g of potassium iodide, mole ratio of Br:I was 98:2, were added by a controlled double-jet method spending for 15 minutes. During the formation of the silver halide grains, the pAg of the solution was kept at 7.7 by simultaneous addition of an aqueous solution of potassium bromide separately prepared. The addition of the solutions was temporary paused and 0.21 ml of a 1% aqueous solution of $K_2IrCl_6$ was added. Then the remained solutions were added. After finishing the addition, the pH value of the emulsion was adjusted to 5.0 by a 5% solution of sodium hydroxide. Thus cubic silver iodobromide grains were obtained which have an average size of 0.068 $\mu$m, a variation coefficient of grain size of 11% and a [100] face ratio of 87%.

The emulsion was flocculated and precipitated by using a gelatin flocculating agent, Demol manufactured by Kao Co. Ltd., and a 20 wt-% aqueous solution of magnesium sulfate. The supernatant was decanted and purified water was added to was the emulsion. Such the operation was repeated three times. Then 0.1 g of phenoxyethanol was added, and the pH and pAg of the emulsion were each adjusted to 5.9 and 7.5, respectively. The emulsion was optionally subjected to a chemical sensitization by sodium thiosulfate and chloroauric acid. Thus silver halide emulsion A was prepared.

<Preparation of Sodium Salt of Fatty Acid Solution B>

Figure 2:
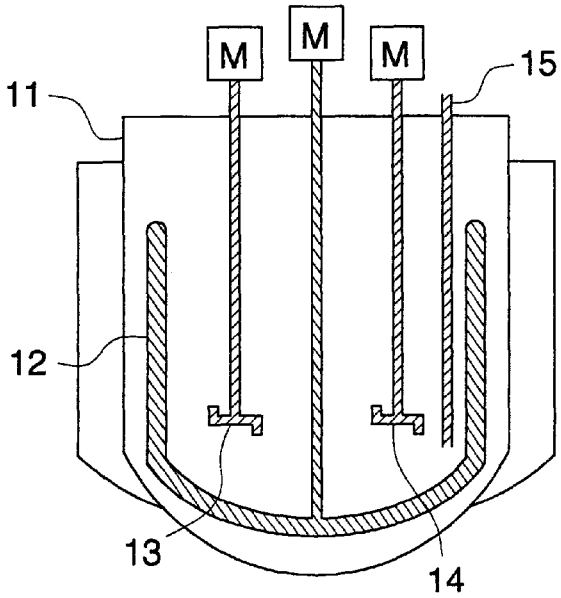
FIG. 2 is a cross-section showing the schema of the reaction apparatus using for the preparation of the organic silver salt.

Combimix SL-10, manufactured by Tokushu Kika Kogyo Co., Ltd., was used for preparing the organic silver salt. A schematic cross-section of that is shown in FIG. 2. The organic silver salt was prepared using the Combimix SL-10 according to the following procedure. The core of reaction apparatus of Combimix SL-10 is represented by 11 in FIG. 2. In the reaction vessel, 111.4 g of behenic acid, 83.8 g of arachidic acid, 54.9 g of stearic acid were dissolved in 4725 ml of purified water at 80° C. At this time, the rotation speed of anchor mixer 12 was set at 100 rpm, and that of each of dispermixers 13 and 14 was set so that the dispermixers were each rotated at 1500 rpm in reverse direction from each other.

Then 540.2 ml of a 1.5 M aqueous solution of sodium hydroxide was added. After that, 6.9 ml of concentrated nitric acid was added and the solution was cooled by 55° C. Thus sodium salt of fatty acid solution B was prepared.

<Preparation of Dispersion of Silver Halide and Organic Silver Salt E11>

To the sodium salt of fatty acid solution B, 63.0 g of the silver halide emulsion A and 450 ml were added while the temperature of the sodium salt of fatty acid solution B was maintained at 55° C. At this time the rotation speed of the anchor mixer 12 was set at 120 rpm and that of each of the dispermixers 13 and 14 was set at 2500 rpm, respectively. The rotation speed of the anchor mixer 12 was set at 165 rpm and that of each of the dispermixers 13 and 14 was set at 5000 rpm, respectively, and 780 ml of 1M silver nitrate aqueous solution was added spending 2 minutes near the dispermixer 13 through the silver nitrate supplying pipe 15. Then the rotation speed of each of the dispermixers 13 and 14 was set at 4500 rpm, and the solution was stirred for 10 minutes. Thus an organic silver salt dispersion was obtained. In the figure, M is a stirring motor.

After that, the organic silver salt dispersion was moved into a vessel having a volume of 60 l and pure water was added to the dispersion. The water added dispersion was stirred and stood for floating and separating the organic silver salt dispersion. After the separation, the water layer under the floated matter was removed to remove water soluble salts. Such the desalted operation was repeated for 4 times. Then excessive water was removed by a tripod hanging type centrifuge H-122 type BS-020, manufactured by Kokusan Co., Ltd. The separated matter was dried by hot air heated at 40° C. in a box type dryer for 70 hours so that the moisture content was become by 0.3%. Thus a dried powder of the organic silver salt dispersion was obtained.

To obtain the dispersion of silver halide and organic silver salt E11, 125 g of the above-obtained dried powder of the organic silver slat dispersion, 3.6 g of polyvinylbutyral, and 363 g of methyl ethyl ketone were mixed while stirring and dispersed with 280 kgf/cm$^2$ (4,000 psi).

The average particle diameter and the ratio of the particles of organic silver salt having and the volume average particle diameter of not more than 0.9 $\mu$m (particle diameter distribution) were determined by a granularity measuring apparatus S4700 Version PCS, manufactured by Malvern Co., Ltd. The average particle diameter was 1.10 $\mu$m and the ratio was 54 Wt-%, and the amount of the light sensitive silver halide was 0.02 moles per mole of organic silver salt.

<Preparation of Dispersion of Silver Halide and Organic Silver Salt E12>

Dispersion of silver halide and organic silver salt E12 was prepared in the same manner as in the preparation of the dispersion of silver halide and organic silver salt E11 except that the condition for dispersing the dried powder is changed to 370 kgf/cm2 (psi). The average particle diameter and the ratio were measured in the same manner as the above, the values of them were each 0.98 $\mu$m and 66 wt-%, respectively.

<Preparation of Dispersion of Silver Halide and Organic Silver Salt E13>

Dispersion of silver halide and organic silver salt E13 was prepared in the same manner as in the preparation of the dispersion of silver halide and organic silver salt E11 except that the condition for dispersing the dried powder is changed to 460 kgf/cm$^2$ (psi). The average particle diameter and the ratio were measured in the same manner as the above, the values of them were each 0.77 $\mu$m and 83 wt-%, respectively.

<Preparation of dispersion of Silver Halide and Organic Silver Salt E14>

Dispersion of silver halide and organic silver salt E14 was prepared in the same manner as in the preparation of the dispersion of silver halide and organic silver salt E11 except that the condition for dispersing the dried powder is changed to 560 kgf/cm$^2$ (psi). The average particle diameter and the ratio were measured in the same manner as the above, the values of them were each 0.69 $\mu$m and 92 wt-%, respectively.

<Preparation of Dispersion of Silver Halide and Organic Silver Salt E15>

Dispersion of silver halide and organic silver salt E15 was prepared in the same manner as in the preparation of the dispersion of silver halide and organic silver salt E14 except that the amount of the silver halide emulsion A added to the sodium salt of fatty acid solution B was changed.

The average particle diameter and the ratio were measured in the same manner as the above, the values of them were each 0.73 $\mu$m and 90 wt-%, respectively. The amount of the light-sensitive silver halide was 0.32 moles per mole of the organic silver salt.

<Preparation of Dispersion of Silver Halide and Organic Silver Salt E16>

Dispersion of silver halide and organic silver salt E16 was prepared in the same manner as in the preparation of the dispersion of silver halide and organic silver salt E14 except that the amount of the silver halide emulsion A added to the sodium salt of fatty acid solution B was changed.

The average particle diameter and the ratio were measured in the same manner as the above, the values of them were each 0.71 $\mu$m and 90 wt-%, respectively. The amount of the light-sensitive silver halide was 0.21 moles per mole of the organic silver salt.

<Preparation of Dispersion of Silver Halide and Organic Silver Salt E17>

Dispersion of silver halide and organic silver salt E17 was prepared in the same manner as in the preparation of the dispersion of silver halide and organic silver salt E14 except that the amount of the silver halide emulsion A added to the sodium salt of fatty acid solution B was changed.

The average particle diameter and the ratio were measured in the same manner as the above, the values of them were each 0.70 $\mu$m and 92 wt-%, respectively. The amount of the light-sensitive silver halide was 0.10 moles per mole of the organic silver salt.

<Preparation of Subbed PET Photographic Support>

The both surfaces of a PET film having a thickness of 100 $\mu$m available on the market were subjected to a treatment by corona discharge of 8 W/m$^2$-minute. On one of the surfaces, the following subbing layer coating liquid a-1 was coated and dried so that the dried thickness was 0.8 $\mu$m to form a subbing layer A-1. On the opposite surface, the following antistatic subbing layer coating liquid b-1 was coated and dried so that the dried thickness was 0.8 $\mu$m to form an antistatic subbing layer B-1.

(Subbing Layer Coating Liquid a-1)

| | |
|---|---|
| Latex having a solid content of 30% of a copolymer of 30 wt-% of butyl acrylate, 20 wt-% of t-butyl acrylate, 25 wt-% of styrene and 25 wt-% of 2-hydroxyethyl acrylate | 270 g |
| C-1 | 0.6 g |
| Hexamethylene-1,6-bis(ethyleneurea) | 0.8 g |
| Water to make | 1 l |

(Subbing Layer Coating Liquid b-1)

| | |
|---|---|
| Latex having a solid content of 30% of a copolymer of 40 wt-% of butyl acrylate, 20 wt-% of styrene and 40 wt-% of glycidyl acrylate | 270 g |

-continued

| | |
|---|---|
| C-1 | 0.6 g |
| Hexamethylene-1,6-bis(ethyleneurea) | 0.8 g |
| Water to make | 1 l |

Then 8 W/m$^2$·minute of corona discharge was applied to the surfaces of the subbing layers A-1 and B-1. On the subbing layer A-1, the following upper subbing layer coating liquid a-2 was coated and dried so that a upper subbing layer A-2 having a dried thickness thereof was 0.1 $\mu$m was formed. On the subbing layer B-1, the following upper subbing layer coating liquid b-2 was coated and dried so that a upper subbing layer B-2 having a dried thickness thereof was 0.8 $\mu$was formed.

(Upper Subbing Layer Coating Liquid a-2)

| Gelatin | An amount corresponding to 0.4 g/m$^2$ |
|---|---|
| C-1 | 0.2 g |
| C-2 | 0.2 g |
| C-3 | 0.1 g |
| Silica particle (average radius of 3 $\mu$m) | 0.1 g |
| Mater to make | 1 l |
| (Upper subbing layer coating liquid b-2) | |
| C-4 | 60 g |
| Latex of C-5 (solid content of 20%) | 80 g |
| Ammonium sulfate | 0.5 g |
| C-6 | 12 g |
| Polyethylene glycol (weight average molecular weight of 600) | 6 g |
| Water to make | 1 l |

(C-1)

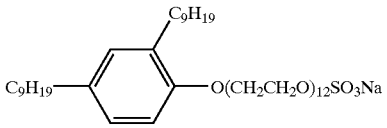

(C-2)

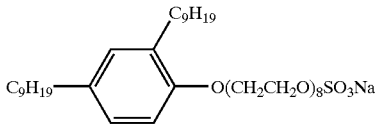

(C-3)

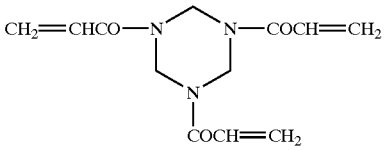

(C-4)

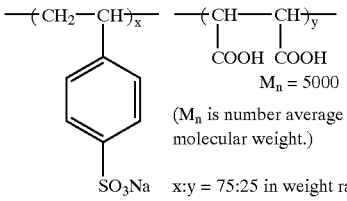

$M_n$ = 5000

($M_n$ is number average molecular weight.)

x:y = 75:25 in weight ratio

-continued (C-5)

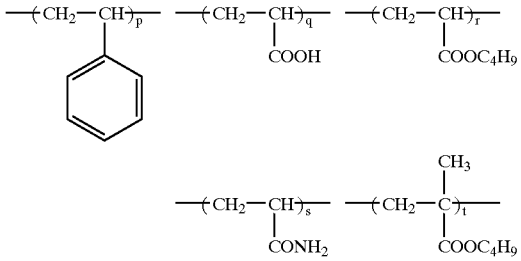

p:q:r:s:t = 40:5:10:5:40 in weight ratio (C-6)

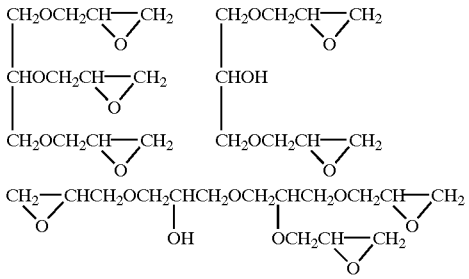

Mixture of the above three compounds (Heat Treatment to the Support)

In the course of the drying process of the subbing layer, the support was heated by 140° C. and gradually cooled.

<Preparation of Heat Developable Light-sensitive Element>

The following liquids were coated in due order on the above-prepared subbed PET support and dried at 60° C. for 15 minutes to prepare Sample 11. Samples 12 through 17 were prepared in the same manner as in Sample 11 except that the silver halide and organic silver salt dispersion E11 was replaced by the silver halide and organic silver salt dispersions E12 through E17, respectively.;

(Coating on the Back Side)

Back side: A liquid having the following composition was coated on the back side of the support.

Cellulose acetate

| | |
|---|---|
| Cellulose acetate (10% methyl ethyl ketone solution) | 15 ml/m$^2$ |
| Dye B | 7 mg/m$^2$ |
| Dye C | 7 mg/m$^2$ |
| Matting agent: monodispersed silica having a monodispersity of 15% and an average particle size of 10 $\mu$m | 30 mg/m$^2$ |
| $C_9H_{19}$—$C_6H_4$—$SO_3Na$ | 10 mg/m$^2$ |

Dye-B

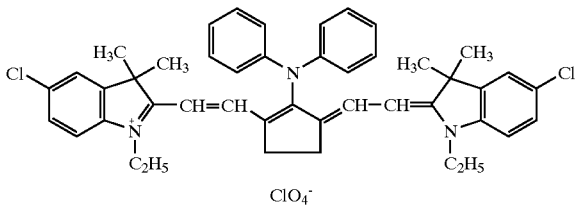

-continued

Dye-C

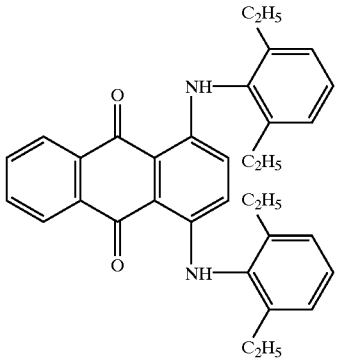

(Coating of Light-sensitive Layer)

Light-sensitive layer: a coating liquid having the following composition was coated and dried so that the coated silver amount was 2.1 g/m$^2$.

Silver halide and organic silver salt dispersion E11 240 g

Sensitizing dye (0.1% methanol solution) 1.7 ml

Pyridinium hydrobromide perbromide (6% methanol solution) 3 ml

Calcium bromide (0.1% methanol solution) 1.7 ml

Antifoggant-2 (10% methanol solution) 1.2 ml 2-(4-chlorobenzoylbenzoic acid) (12% methanol solution) 9.2 ml 2-mercaptobenzimidazole (1% methanol solution) 11 ml Tribromomethylsulfoquinoline (5% methanol solution) 17 ml 1,1-bis(2-hydroxy-3,5-dimethylphenyl)-3,5,5-trimethylhexane (20% methanol solution) 29.5 ml -continued

| | |
|---|---|
| Tetrachlorophthalic acid | 150 mg/m$^2$ |
| Tetrachlorophthalic anhydride | 170 mg/m$^2$ |
| Matting agent: | |
| monodispersed silica having a monodispersity of 10% and an average particle size of 14 $\mu$m | 70 mg/m$^2$ |
| $C_9H_{19}$—$C_6H_4$—$SO_3Na$ | 10 mg/m$^2$ |

<Evaluation of Characteristics of Heat-developable Light-sensitive Element>

(Determination of Sphere of Influence)

The above-prepared heat-developable light sensitive elements were each exposed to light by an imager having a semiconductor laser emitting light of 810 nm so that the exposing light amount was 40 $\mu$J/cm$^2$. Then the heat-developable light-sensitive element was thermally developed by an automatic developing apparatus. The development was carried out under two kinds of condition: for 8 seconds at 132° C. and for 16.5 seconds at 132° C., in a room conditioned at 23° C. and 50% RH. The developed sample was sliced to an ultra thin slice and observed by a TEM. The average sphere of influence formed by each of the conditions was determined according to the projection area observed by the TEM. Results are shown in Table 1.

(Laser Exposure and Heat Development)

The above-prepared heat-developable light-sensitive elements were each wedgewise exposed to light by an imager having a laser emitting light of 810 nm. Then the exposed heat-developable element was developed by an automatic developing apparatus for 16.5 seconds at 123° C. The exposing and the development were carried out in a room conditioned at 23° C. and 50% of RH.

(Evaluation of Photographic Characteristics)

Sensitizing dye

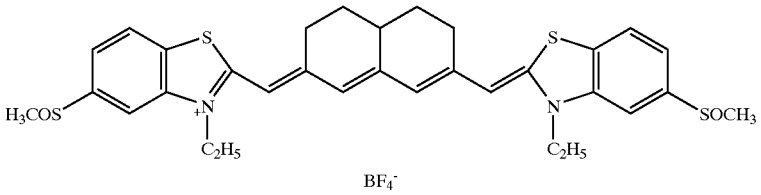

Antifoggant-2

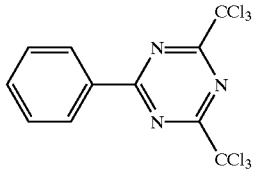

Surface protective layer: A liquid having the following composition was coated on the light-sensitive layer.

| | |
|---|---|
| Acetone | 35 ml/m$^2$ |
| Methyl ethyl ketone | 17 ml/m$^2$ |
| Cellulose acetate | 2.3 g/m$^2$ |
| Methanol | 7 ml/m$^2$ |
| Phthalazine | 250 mg/m$^2$ |
| 4-methylphthalic acid | 180 mg/m$^2$ |

After the development, the image was evaluated by a densitometer PDA-65, manufactured by Konica Corp. Results of the measurement were evaluated by the fog density and the maximum density. The fog was described in the absolute value and the maximum density was described in the relative value when the value of Sample 11 was set at 100.

The above-obtained results and the results of sphere of influence measurement are shown in table 1.

TABLE 1

| Sample | Average diameter of organic silver salt ($\mu$m) | Ratio of organic silver salt particles having a diameter not more than 0.9 $\mu$m (wt-%) | Silver halide/ organic silver salt (Mole ratio) | Influential area r ($\mu$m) | Ratio of influential area ($r_2/r_1$) | Fog | Maximum density | Remarks |
|---|---|---|---|---|---|---|---|---|
| 11 | 1.10 | 54 | 0.02 | 0.26 | 1.41 | 0.24 | 100 | Comparative |
| 12 | 0.89 | 66 | 0.02 | 0.39 | 1.63 | 0.20 | 105 | Inventive |
| 13 | 0.77 | 83 | 0.02 | 0.52 | 2.33 | 0.19 | 107 | Inventive |
| 14 | 0.69 | 92 | 0.02 | 0.76 | 2.46 | 0.17 | 109 | Inventive |
| 15 | 0.73 | 90 | 0.32 | 0.34 | 2.91 | 0.21 | 106 | Inventive |
| 16 | 0.71 | 90 | 0.21 | 0.80 | 2.79 | 0.18 | 110 | Inventive |
| 17 | 0.70 | 92 | 0.10 | 0.83 | 2.51 | 0.16 | 111 | Inventive |

Table 1 shows that in the samples according to the invention the fog is lowered and the maximum density is raised compared with those in the comparative sample. Moreover, the evaluations were carried out in the same manner as in the above-mentioned except that the developing temperature was changed from 123° C. to 117° C. It was confirmed that the density variation depending on the developing temperature was considerably inhibited in the sample according to the invention.

A heat-developable light-sensitive element giving a low fog and a high maximum density and inhibited in the variation of density depending on the fluctuation of developing temperature can be obtained by the invention.

What is claimed is:

1. A heat-developable light-sensitive element comprising a reducing agent, a non-light-sensitive organic silver salt and a light-sensitive silver halide wherein an average radius r of the sphere of influence is from 0.5 $\mu$m to 1 $\mu$m when the element is exposed to light of from 35 $\mu$J/cm to 50 $\mu$J/cm$^2$ and developed by a developing drum at a temperature of 123°±3° C. for a time of 16±3 seconds.

2. The heat-developable light-sensitive element of claim 1 wherein ratio $r_2/r_1$ is from 1.5 to 3.0, wherein $r_1$ is an average radius of sphere of influence when the element is exposed to light of from 35 $\mu$J/cm$^2$ to 50 $\mu$J/cm$^2$ and developed by a developing drum at a temperature of 123°±3° C. for a time of 8±3 seconds, and $r_2$ is an average radius of sphere of influence when the element is exposed to light of from 35 $\mu$J/cm$^2$ to 50 $\mu$J/cm$^2$ and developed by a developing drum at a temperature of 123°±3° C. for a time of 16±3 seconds.

3. The heat-developable light-sensitive element of claim 2 wherein the ratio $r_2/r_1$, is within the range of from 2.0 to 2.8.

4. The heat-developable light-sensitive element of claim 1 wherein the element is developed by KONICA LASER IMAGER DRYPRO MODEL 722.

* * * * *